US007680653B2

(12) United States Patent
Yeldener

(10) Patent No.: US 7,680,653 B2
(45) Date of Patent: Mar. 16, 2010

(54) BACKGROUND NOISE REDUCTION IN SINUSOIDAL BASED SPEECH CODING SYSTEMS

(75) Inventor: Suat Yeldener, Palatine, IL (US)

(73) Assignee: Comsat Corporation, Bethesda, MD (US)

( * ) Notice: Subject to any disclaimer, the term of this patent is extended or adjusted under 35 U.S.C. 154(b) by 300 days.

(21) Appl. No.: 11/772,768

(22) Filed: Jul. 2, 2007

(65) Prior Publication Data

US 2008/0140395 A1 Jun. 12, 2008

Related U.S. Application Data

(63) Continuation of application No. 11/598,813, filed on Nov. 14, 2006, now abandoned, which is a continuation of application No. 10/504,131, filed as application No. PCT/US01/04526 on Feb. 12, 2001, now abandoned.

(60) Provisional application No. 60/181,734, filed on Feb. 11, 2000.

(51) Int. Cl.
*G10L 21/02* (2006.01)

(52) U.S. Cl. ..... 704/227; 704/226; 704/223; 704/230; 704/207; 704/219

(58) Field of Classification Search ..... 704/226, 704/223, 224, 227, 228, 230, 233, 207, 205, 704/209, 267, 268, 265, 219, 229
See application file for complete search history.

(56) References Cited

U.S. PATENT DOCUMENTS

| | | | | |
|---|---|---|---|---|
| 4,937,873 | A * | 6/1990 | McAulay et al. | 704/265 |
| 5,054,072 | A * | 10/1991 | McAulay et al. | 704/207 |
| 5,664,051 | A * | 9/1997 | Hardwick et al. | 704/206 |
| 6,070,137 | A * | 5/2000 | Bloebaum et al. | 704/227 |
| 6,182,033 | B1 * | 1/2001 | Accardi et al. | 704/223 |
| 6,453,287 | B1 * | 9/2002 | Unno et al. | 704/219 |
| 6,691,082 | B1 * | 2/2004 | Aguilar et al. | 704/219 |
| 6,862,567 | B1 * | 3/2005 | Gao | 704/228 |
| 6,931,373 | B1 * | 8/2005 | Bhaskar et al. | 704/230 |
| 6,996,523 | B1 * | 2/2006 | Bhaskar et al. | 704/222 |
| 7,013,269 | B1 * | 3/2006 | Bhaskar et al. | 704/219 |
| 7,092,881 | B1 * | 8/2006 | Aguilar et al. | 704/233 |
| 7,590,531 | B2 * | 9/2009 | Khalil et al. | 704/228 |

* cited by examiner

*Primary Examiner*—Vijay B Chawan
(74) *Attorney, Agent, or Firm*—Sughrue Mion, PLLC

(57) ABSTRACT

A method and apparatus to reduce background noise in speech signals in order to improve the quality and intelligibility of processed speech. In mobile communications environment, speech signals are degraded by additive random noise. A randomness of the noise, which is often described in terms of its first and second order statistics, make it difficult to remove much of the noise without introducing background artifacts. This is particularly true for lower signal to background noise ratios. The method and apparatus provides noise reduction without any knowledge of the signal to background noise ratio.

16 Claims, 5 Drawing Sheets

BACKGROUND NOISE REDUCTION IN SINUSOIDAL BASED SPEECH CODING SYSTEMS

This is a continuation of application Ser. No. 11/598,813 filed Nov. 14, 2006, which is a continuation of application Ser. No. 10/504,131 filed Aug. 8, 2002, and of PCT/US01/04526 filed Feb. 12, 2001, which claims benefit of Provisional Application No. 60/181,734 filed Feb. 11, 2000. The entire disclosures of the prior applications are hereby incorporated by reference.

BACKGROUND OF THE INVENTION

Speech enhancement involves processing either degraded speech signals or clean speech that is expected to be degraded in the future, where the goal of processing is to improve the quality and intelligibility of speech for the human listener. Though it is possible to enhance speech that is not degraded, such as by high pass filtering to increase perceived crispness and clarity, some of the most significant contributions that can be made by speech enhancement techniques is in reducing noise degradation of the signal. The applications of speech enhancement are numerous. Examples include correction for room reverberation effects, reduction of noise in speech to improve vocoder performance and improvement of un-degraded speech for people with impaired hearing. The degradation can be as different as room echoes, additive random noise, multiplicative or convolutional noise, and competing speakers. Approaches differ, depending on the context of the problem. One significant problem is that of speech degraded by additive random noise, particularly in the context of a Harmonic Excitation Linear Predictive Speech Coder H-LPC).

The selection of an error criteria by which speech enhancement systems are optimized and compared is of central importance, but there is no absolute best set of criteria. Ultimately, the selected criteria must relate to the subjective evaluation by a human listener, and should take into account traits of auditory perception. An example of a system that exploits certain perceptual aspects of speech is that developed by Drucker, as described in "Speech Processing in a High Ambient Noise Environment", IEEE Trans. On AudioElectroacoustics, Vol.: Au-16, pp: 165-168, June 1968. Based on experimental findings, Drucker concluded that a primary cause for intelligibility loss in speech degraded by wide-band noise is confusion between fricatives and plosive sounds, which is partially due to a loss of short pauses immediately before the plosive sounds. Drucker reports a significant improvement in intelligibility after high pass filtering the /s/ fricative and inserting short pauses before the plosive sounds. However, Drucker's assumption that the plosive sounds can be accurately determined limits the usefulness of the system.

Many speech enhancement techniques take a more mathematical approach, which are empirically matched to human perception. An example of a mathematical criterion that is useful in matching short time spectral magnitudes, a perceptually important characterization of speech, is the mean squared error (MSE). A computational advantage to using this criteria is that the minimum MSE reduces to a linear set of equations. Other factors, however, can make an "optimally small" MSE misleading. In the case of speech degraded by narrow-band noise, which is considerably less comfortable to listen to than wide-band noise, wide-band noise can be added to mask the more unpleasant narrow-band noise. This technique makes the mean squared error larger.

The enhancement of speech degraded by additive noise has led to diverse approaches and systems. Some systems, like Drucker's, exploit certain perceptual aspects of speech. Others have focused on improving the estimate of the short time Fourier transform magnitude (STFTM), which is perceptually important in characterizing speech. The phase, on the other hand, may be considered as relatively unimportant.

Because the STFTM of speech is perceptually very important, one approach has been to estimate the STEM of clean speech, given information about the noise source. Two classes of techniques have evolved out of this approach. In the first, the short time spectral amplitude is estimated from the spectrum of degraded speech and information about the noise source. Usually, the processed spectrum adopts the phase of the spectrum of the noisy speech because phase information is not as important perceptually. This first class includes spectral subtraction, correlation subtraction and maximum likelihood estimation techniques. The second class of techniques, which includes Wiener filtering, uses the degraded speech and noise information to create a zero-phase filter that is then applied to the noisy speech. As reported by H. L. Van Trees in "Detection, Estimation and Modulation Theory", Pt. 1, John Wiley and Sons, New York, N.Y. 1968, with Wiener filtering the goal is to develop a filter which can be applied to noisy speech to form the enhanced speech.

Turning first to the class concerned with estimation of short time spectral amplitude, particularly where spectral subtraction is used, statistical information is obtained about the noise source to estimate the STFTM of clean speech. This technique is also known as power spectrum subtraction. Variations of these techniques included the more general relation identified by Lim et al in "Enhancement and Bandwidth Compression of Noisy Speech", Proc. of the IEEE, Vol:. 67, No.: 12, December 1979, as:

$$|\hat{S}(\omega)|^{\alpha}=|Y(\omega)|^{\alpha}-\beta E[|N(\omega)|^{\alpha}] \quad (1)$$

where $\alpha$ and $\beta$ are parameters that can be chosen. Magnitude spectral subtraction is the case where $\alpha=1$, and $\beta=1$. A different subtractive speech enhancement algorithm was presented by McAulay and Malpass in "Speech Enhancement Using Soft Decision Noise Suppression Filter", IEEE Trans. on Acoustics, Speech and Signal Processing, Vol:. ASSP-28, No.: 2, pp: 137-145, April 1980. Their method uses a maximum-likelihood estimate of the noisy speech signal assuming that the noise is gaussian. When the enhanced magnitude yields a value smaller than an attenuation threshold, however, the spectral magnitude is automatically set to the defined threshold.

Spectral subtraction is generally considered to be effective at reducing the apparent noise power in degraded speech. Lim has shown however that this noise reduction is achieved at the price of lower speech inteligibility (8). Moderate amounts of noise reduction can be achieved without significant intelligibility loss, however, large amount of noise reduction can seriously degrade the intelligibility of the speech. Other researchers have also drawn attention to other distortions which are introduced by spectral subtraction (5). Moderate to high amounts of spectral subtraction often introduce "tonal noise" into the speech.

Another class of speech enhancement methods exploits the periodicity of voiced speech to reduce the amount of background noise. These methods average the speech over successive pitch periods, which is equivalent to passing the speech through an adaptive comb filter. In these techniques, harmonic frequencies are passed by the filter while other frequencies are attenuated. This leads to a reduction in the noise between the harmonics of voiced speech. One problem with this technique is that it severely distorts any unvoiced spectral regions. Typically this problem is handled by classifying each segment as either voiced or unvoiced and then only applying the comb filter to voiced regions. Unfortunately, this approach does not account for the fact that even at modest noise levels many voiced segments have large frequency regions which are dominated by noise. Comb filtering these noise dominated frequency regions severely changes the perceived characteristics of the noise.

These known problems with current speech enhancement methods have generated considerable interest in developing new or improved speech enhancement methods which are capable of reducing the substantial amount of noise without adding noticeable artifacts into the speech signal. A particular application for such technique is the Harmonic Excitation Linear Predictive Coding (HE-LPC), although it is desirable for such technique to be applicable to any sinusoidal based speech coding algorithm.

The conventional Harmonic Excitation Linear Predictive Coder (HE-LPC) is disclosed in disclosed in S. Yeldener "A 4 kb/s Toll Quality Harmonic Excitation Linear Predictive Speech Coder", Proc. of ICASSP-1999, Phoenix, Ariz., pp: 481-484, March 1999, which is incorporated herein by reference. A simplified block diagram of the conventional HE-LPC coder is shown in FIG. 1. In the illustrated HE-LPC speech coder 100, the basic approach for representation of speech signals is to use a speech synthesis model where speech is formed as the result of passing an excitation signal through a linear time varying LPC filter that models the characteristics of the speech spectrum. In particular, input speech 101 is applied to a mixer 105 along with a signal defining a window 102. The mixer output 106 is applied to a fast Fourier transform FFT 110, which produces an output 111, and an LPC analysis circuit 130, which itself produces an output 131 to an LPC-LSF transform circuit 140. The LPC-LSF transform circuit 140 combines to act as a linear time-varying LPC filter that models the resonant characteristics of the speech spectral envelope. The LPC filter is represented by a plurality of LPC coefficients (14 in a preferred embodiment) that are quantized in the form of Line Spectral Frequency (LSF) parameters. The output 131 of the LPC analysis is provided to an inverse frequency response unit 150, whose output 151 is applied to mixer 155 along with the output 111 of the FFT circuit 110. The same output 111 is applied to a pitch detection circuit 120 and a voicing estimation circuit 160.

In the HE-LPC speech coder, the pitch detection circuit 120 uses a pitch estimation algorithm that takes advantage of the most important frequency components to synthesize speech and then estimate the pitch based on a mean squared error approach. The pitch search range is first partitioned into various sub-ranges, and then a computationally simple pitch cost function is computed. The computed pitch cost function is then evaluated and a pitch candidate for each sub-range is obtained. After pitch candidates are selected, an analysis by synthesis error minimization to procedure is applied to choose the most optimal pitch estimate. In is case, the LPC residual signal is low pass filtered first and then the low pass filter excitation signal is passed through an LPC synthesis filter to obtain the reference speech signal. For each candidate of pitch, the LPC residual spectrum is sampled at the harmonics of the corresponding pitch candidate to get the harmonic amplitude and phases. These harmonic components are used to generated a synthetic excitation signal based on the assumption that the speech is purely voiced. This synthetic excitation signal is then passed through the LPC synthesis filter to obtain the synthesized speech signal. The perceptually weighted mean squared error (PWMSE) in between the reference and synthesized signal is then computed and repeated for each candidate of pitch. The candidate pitch period having the least PWMSE is then chosen as the most optimal pitch estimate P.

Also significant to the operation of the HE-LPC is the computation of the voicing probability that defines a cutoff frequency in voicing estimation circuit 160. First, a synthetic speech spectrum is computed based on the assumption that speech signal is fully voiced. The original and synthetic speech signals are then compared and a voicing probability is computed on a harmonic-by-harmonic basis, and the speech spectrum is assigned as either voiced or unvoiced, depending on the magnitude of the error between the original and reconstructed spectra for the corresponding harmonic. The computed voicing probability Pv is then applied to a spectral amplitude estimation circuit 170 for an estimation of spectral amplitude $A_k$ for the $k^{th}$ harmonic. A quantize and encoder unit 180 receives the pitch detection signal P, the noise residual in the amplitude, the voicing probability Pv and the spectral amplitude $A_k$, along with the output $lsf_j$ of the LPC-LCF transform 140 to generate an encoded output speech signal for application to the output channel 181.

In other coders to which the invention would apply, the excitation signal would also be specified by a consideration of the fundamental frequency, spectral amplitudes of the excitation spectrum and the voicing information.

At the decoder 200, as illustrated in FIG. 2, the transmitted signal is deconstructed into its components $lsf_j$, P and Pv. Specifically, signal 201 from the channel is input to a decoder 210, which generates a signal $lsf_j$ for input to a LSF-LPC transform circuit 220, a pitch estimate P for input to voiced speech synthesis circuit 240 and a voicing probability PV, which is applied to voicing control circuit 250. The voicing control circuit provides signals to synthesis circuits 240 and 260 via inputs 251 and 252. The two synthesis circuits 240 and 260 also receive the output 231 of an amplitude enhancing circuit 230, which receives an amplitude signal $A_k$ from the decoder 210 at its input.

The voiced part of the excitation signal is determined as the sum of the sinusoidal harmonics. The unvoiced part of the excitation signal is generated by weighting the random noise spectrum with the original excitation spectrum for the frequency regions determined as unvoiced. The voiced and unvoiced excitation signals are then added together at mixer 270 and passed through an LPC synthesis filter 280, which responds to an input from the LPC-LSF transform 220 to form the final synthesized speech. At the output, a post-filter 290, which also receives an input from the LSF-LPC transform circuit 220 via an amplifier 225 with a constant gain $\alpha$ is used to further enhance the output speech quality. This arrangement produces high quality speech.

However, the conventional arrangement of HE-LPC encoder and decoder does not provide the desired performance for a variety of input signal and background noise conditions. Accordingly, there is a need for a flirter way to improve speech quality significantly in background noise conditions.

SUMMARY OF THE INVENTION

The present invention comprises the reduction of background noise in a processed speech signal prior to quantization and encoding for transmission on an output channel.

More specifically, the present invention comprises the application of an algorithm to the spectral amplitude estimation signal generated in a speech codec on the basis of detected pitch and voicing information for reduction of background noise.

The present invention further concerns the application of a background noise algorithm on the basis of individual harmonics k in a spectral amplitude estimated signal $A_k$ in a speech codec.

The present invention more specifically concerns the application of a background noise elimination algorithm to any sinusoidal based speech coding algorithm, and in particular, an algorithm based on harmonic excitation linear predictive encoding.

DESCRIPTION OF THE PREFERRED EMBODIMENT

Figure 1:
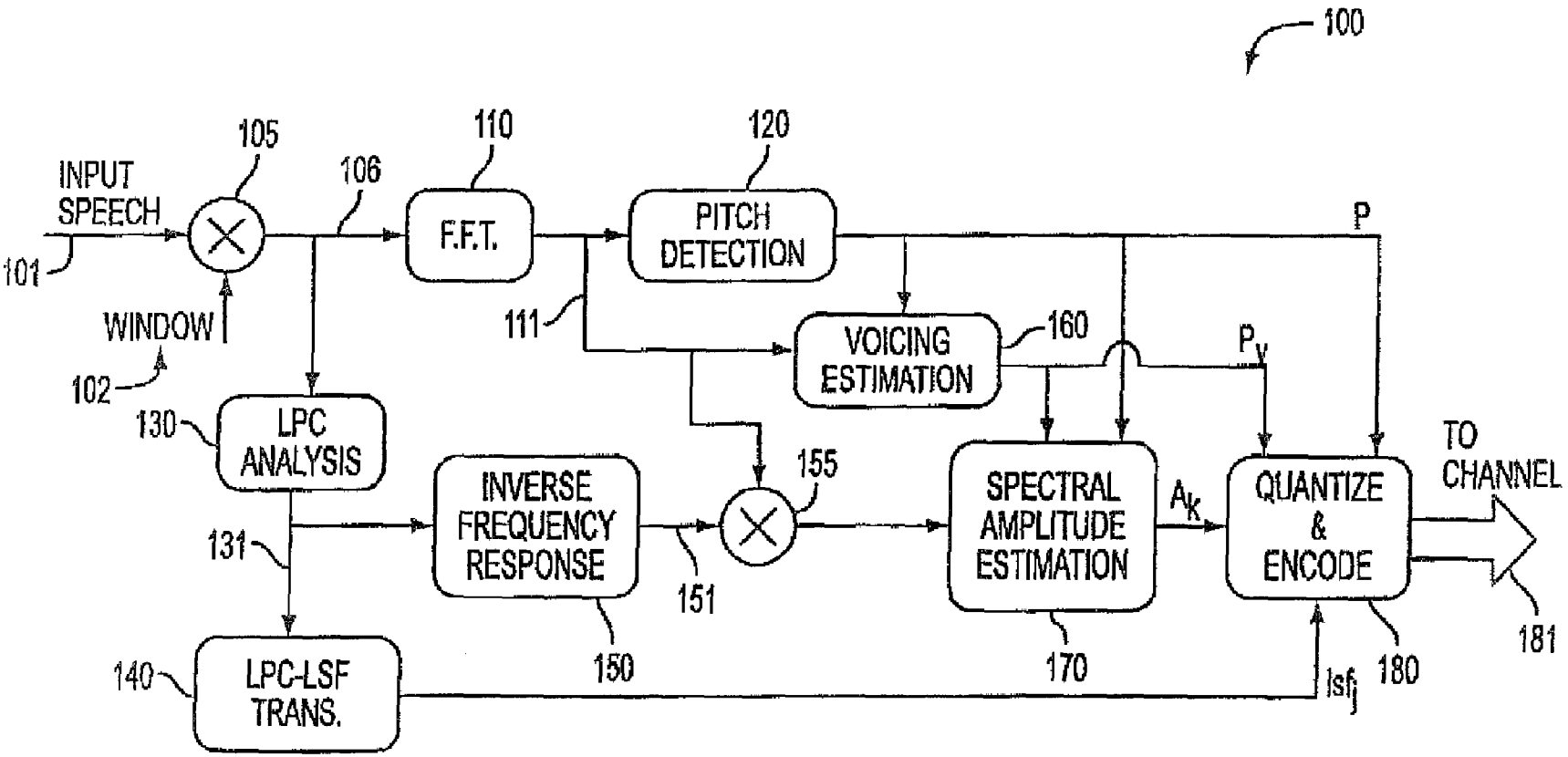
FIG. 1 is a block diagram of a conventional HE-LPC speech encoder.
Figure 2:
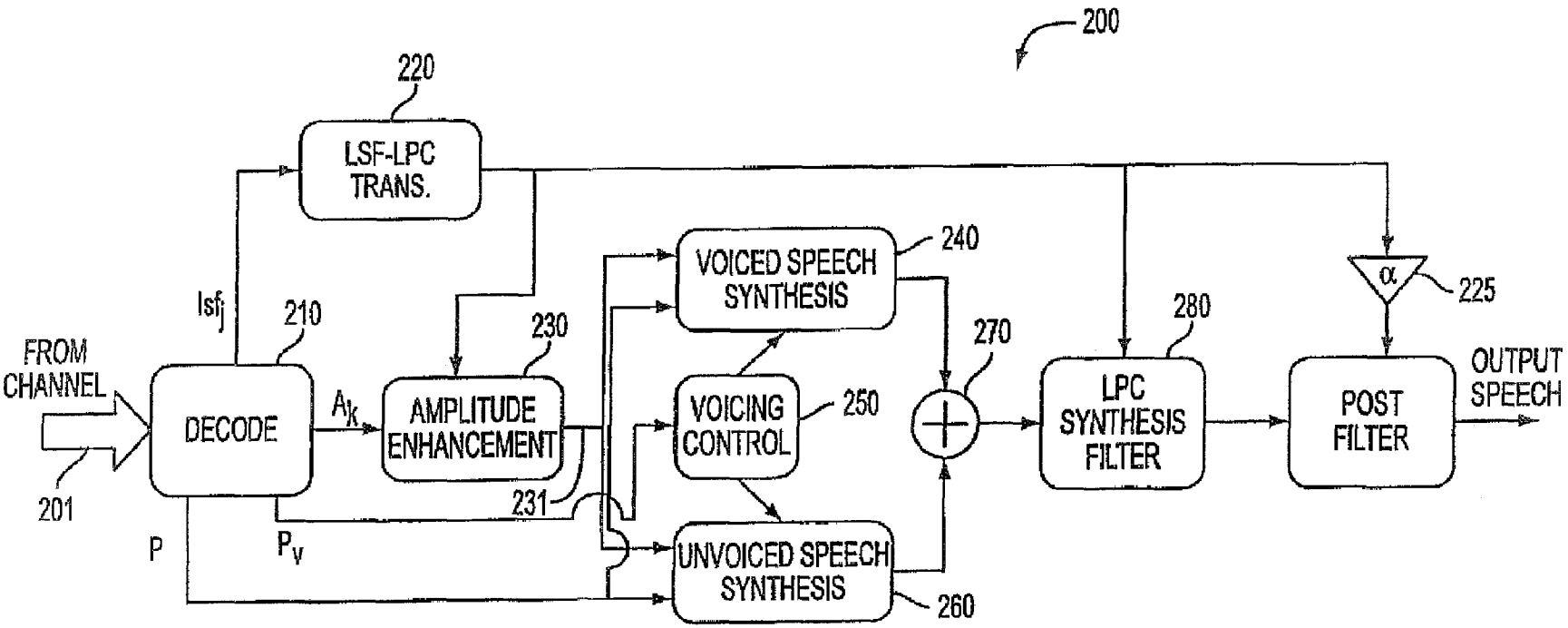
FIG. 2 is a block diagram of a conventional HE-LPC speech decoder.
Figure 3:
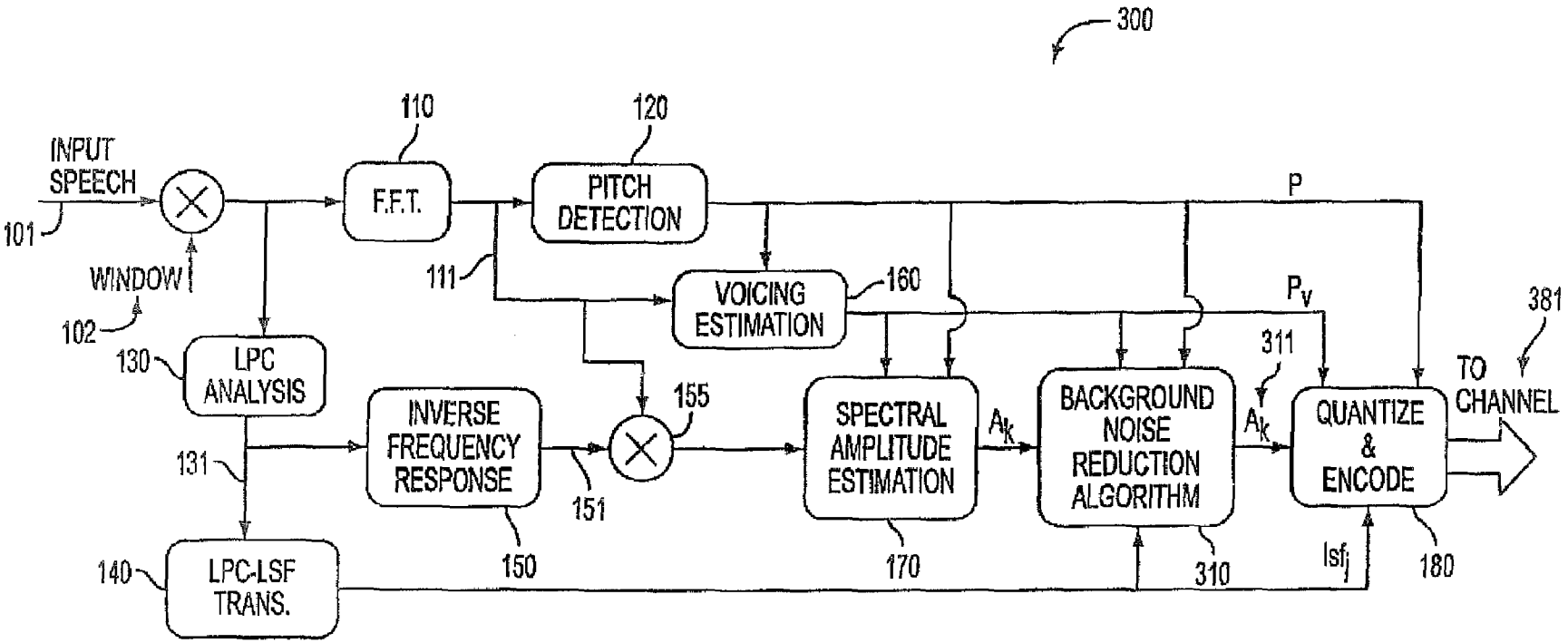
FIG. 3 is a block diagram of a BE-LPC speech encoder in accordance with the present invention.

The preferred embodiment of the present invention can be best appreciated by considering in FIG. 3 the modifications that are made to the HE-LPC encoder that was illustrated in FIG. 1. The same reference numbers from FIG. 1 are used for those components in FIG. 3 that are identical to those utilized in the basic block diagram of the conventional circuit illustrated in FIG. 1. The operation of the components, as described therein, are identical. The notable addition in the improved HE-LPC encoder 300 circuit over the encoder 100 of FIG. 1 is the background noise reduction algorithm 310. The pitch signal P from the pitch detection circuit 120; the voicing probability signal Pv from the voicing estimation circuit 160, the spectral amplitude estimation signal $A_k$ from the spectral amplitude estimation circuit 170 as well as the output of the LPC-LSF circuit 140 are all received by the background noise reduction algorithm 310. The output of that algorithm $A_k$ (hat) 311 is input to the quantize and encode circuit 180, along with signals P, Pv and $A_k$ for generation of the output signal 381 for transmission on the output channel. The processing of the signal $A_k$ in order to reduce the effect of background noise provides a significantly improved and enhanced output onto the channel, which can then be received and processed in the conventional HE-LPC decoder of FIG. 2, in a manner already described.

Figure 4:
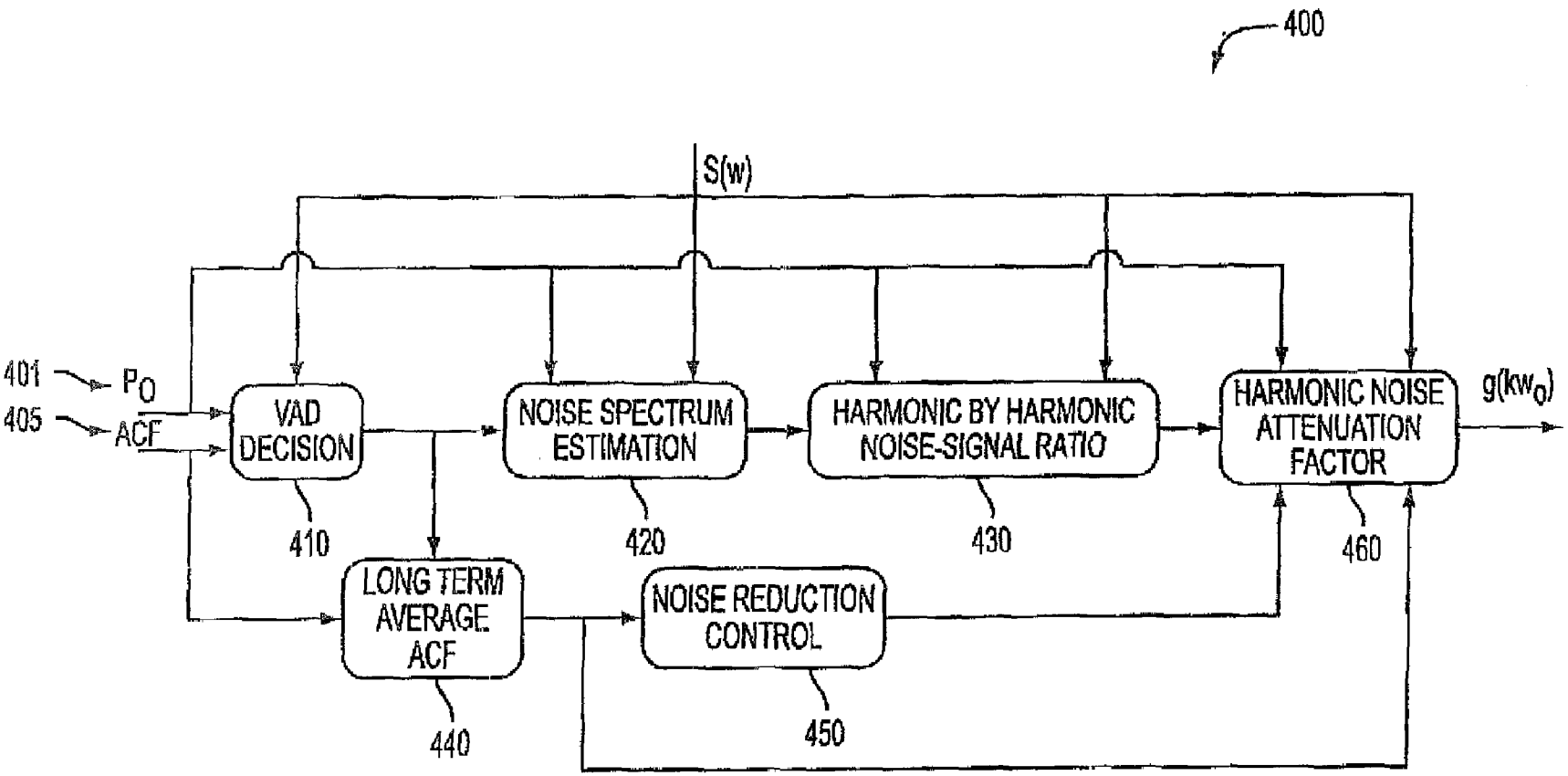
FIG. 4 is a block diagram detailing an implementation of a preferred embodiment of the invention.
Figure 5:
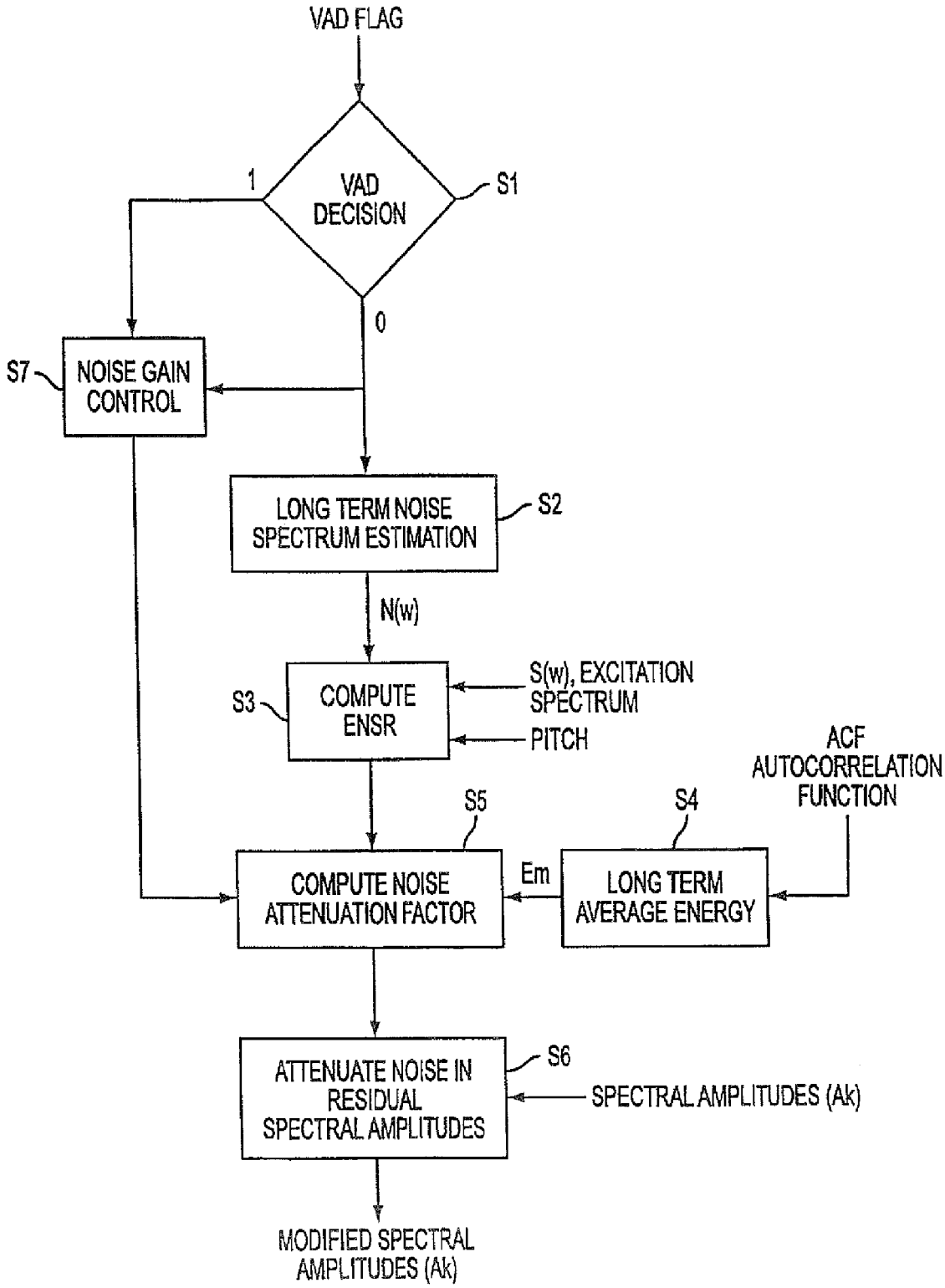
FIG. 5 is a flow chart illustrating a method for achieving background noise reduction in accordance with the present invention.

In considering the detailed operation of the background noise-compensating encoder of the present invention, reference is made to FIGS. 4 and 5, which illustrate the functional block diagram and flowchart of the algorithm that provides the enhanced performance. The algorithm processes the pitch $P_0$, as computed during the encoding process, and an auto-correlation function ACF, which is a function of the energy of the incoming speech as is well known in the art.

The first step S1 of the speech enhancement process is to have a voice activity detection (VAD) decision for each frame of speech signal. The VAD decision in block 410 is based on the periodicity $P_0$ and the auto-correlation function ACF of the speech signal, which appear as inputs on lines 401 and 405, respectively, of FIG. 4. The VAD decision is a 1 if a voice signal is over a given threshold (speech is present) and 0 if it is not over the threshold (speech is absent). If speech is present, there is noise gain control implemented in step S7, as subsequently discussed.

If the VAD decision is that there is no speech, in step S2, the noise spectrum is updated every speech segment where speech is not active, and a long term noise spectrum is estimated in noise spectrum estimation unit 420. The long term average noise spectrum is formulated as (2):

$$|N_m(\omega)| = \begin{cases} \alpha|N_{m-1}(\omega)| + (1-\alpha)|U(\omega)|, & \text{if } VAD = 0; \\ |N_{m-1}(\omega)|, & \text{otherwise.} \end{cases}$$

where $0 \leqq \omega \leqq \pi$, $|N_m(\omega)|$ is the long term noise spectrum magnitude, $\alpha$ is a constant that is can be set to 0.95, and VAD=0 means that speech is not active. In this formulation $|U(\omega)|$ can be formed by two ways. In the first way, $|U(\omega)|$ can be considered to be directly the current signal spectrum. In the second case, harmonic spectral amplitudes are first estimated according to equation (3) as:

$$A_k = \sqrt{\frac{1}{\omega_0} \sum_{\omega=(k-0.5)\omega_0}^{(k+0.5)\omega_0} |S(\omega)|^2} \tag{3}$$

where $A_k$ is the $k^{th}$ harmonic spectral amplitude, and $\omega_0$ is the fundamental frequency of the current signal, $|S(\omega)|$, which is an input to the noise spectrum estimation circuit 320 along with the pitch $P_0$. Notably, $S(\omega)$ and $P_0$ are inputs to each of the VAD decision circuit 410, noise spectrum estimation unit 420, harmonic-by harmonic noise-signal ratio unit 430 and the harmonic noise attenuation factor unit 460, as subsequently discussed.

In step S3, the Estimated Noise to Signal Ratio (ENSR) for each harmonic lobe is calculated on the basis of S(w), excitation spectrum and pitch input. In this case, the ENSR for the $k^{th}$ harmonic is computed as:

$$\gamma_k = \frac{\sum_{\omega=B_L^k}^{B_U^k} [N_m(\omega)W_k(\omega)]^2}{\sum_{\omega=B_L^k}^{B_U^k} [S(\omega)W_k(\omega)]^2} \tag{7}$$

where $\gamma_k$ is the $k^{th}$ ENSR, $N_m$ (m}($\omega$) is the estimated noise spectrum, $S(\omega)$ is the speech spectrum and $W_k(\omega)$ is the window function computed as:

$$W_k(\omega) = 0.52 - \left(0.48 \cos\left(\frac{2\pi[\omega - B_L^k]}{[B_U^k - B_L^k]}\right)\right); B_L^k \leq \omega < B_U^k. \tag{8}$$

where $B^k{}_L$ and $B^k{}_U$ are the lower and upper limits for the $k^{th}$ harmonic and computed as:

$$B_L^k = \left(k - \frac{1}{2}\right)\omega_0 \tag{9}$$

$$B_U^k = \left(k + \frac{1}{2}\right)\omega_0 \tag{10}$$

In step S4, long term average ACF is calculated section 440, using an ACF-autocorrelation function, and on the basis of an input of the VAD decision in section 410, an input is provided to noise reduction control circuit 450, which in step S5 is used to control the noise reduction gain, $\beta_m$, from one frame to the next one:

$$\beta_m = \begin{cases} \beta_{m-1} + \Delta, \text{ if } VAD = 1; \\ \beta_{m-1} - \Delta, \text{ otherwise.} \end{cases} \tag{5}$$

where $\Delta$ is a constant (typically $\Delta$=0.1) and $$\beta_m = \begin{cases} 1.0, & \text{if } \beta_m > 1.0; \\ \min, & \text{if } \beta_m < \min; \end{cases} \tag{6}$$

where min is the lowest noise attenuation factor (typically, min=0.5).

In step S5, a harmonic-by-harmonic noise-signal ratio is calculated in section 430 and the harmonic spectral amplitudes are interpolated according to equation (4) to have a fixed dimension spectrum as:

$$U(\omega) = A_k + [A_{k+1} - A_k(i)]\frac{(\omega - k\omega_0)}{\omega_0}; \tag{4}$$

$$k\omega_0 \le \omega \le (k+1)\omega_0.$$

where $1 \leqq k \leqq L$ and L is the total number of harmonics within the 4 kHz speech band. The noise gain control that is calculated in step S7, on the basis of the VAD decision output 1 and 0, and as represented in the block 450 of FIG. 4, is used as an input to the computation of the noise attenuation factor in step S5. Specifically, in step S5, the noise attenuation factor for each harmonic is calculated as:

$$\alpha_k = \beta_m \sqrt{(1.0 - \mu\gamma\epsilon)} \tag{11}$$

In this case, if $\alpha_k$<0.1, then $\alpha_k$ is set to 0.1. Here, $\mu$ is a constant factor that can be set as:

$$\mu = \begin{cases} 4.0, & \text{if } E_m > 10000.0; \\ 3.0, & \text{if } E_m > 3700.0; \\ 2.5, & \text{otherwise.} \end{cases} \tag{12}$$

where $E_m$ is the long term average energy that can be computed as:

$$E_m = \alpha E_{m-1} + (1.0 - \alpha)E_0 \tag{13}$$

where $\alpha$ is a constant factor (typically $\alpha$=0.95) and $E_0$ is the average energy of the current frame of the speech signal.

The noise attenuation factor for each harmonic that was computed in step S5 is used in step S6 to scale the harmonic amplitudes that are computed during the encoding process of HE-LPC coder, and to attenuate noise in the residual spectral amplitudes $A_k$, and produce the modified spectral amplitudes $A_k$ (hat).

The background noise reduction algorithm discussed above may be incorporated into the Harmonic Excitation Linear Predictive Coder (HE-LPC), or any other coder for a sinusoidal based speech coding algorithm.

The decoder as illustrated in FIG. 2, may be used to decode a signal encoded according to the principles of the present invention, as for decoding a signal processed by the conventional encoder, the voiced part of the excitation signal is determined as the sum of the sinusoidal harmonics. The unvoiced part of the excitation signal is generated by weighting the random noise spectrum with the original excitation spectrum for the frequency regions determined as unvoiced. The voiced and unvoiced excitation signals are then added together to form the final synthesized speech. At the output, a post-filter is used to further enhance the output speech quality.

While the present invention is described with respect to certain preferred embodiments, the invention is not limited thereto. The full scope of the invention is to be determined on the basis of the issued claims, as interpreted in accordance with applicable principles of the U.S. Patent Laws.

The invention claimed is:

1. A speech codec comprising:

an input for receiving a speech signal;

a linear time varying LPC filter that models the characteristics of the speech spectrum;

a pitch detection section for generating an estimate of optimal pitch in the received speech;

a voicing estimation section for computing the voicing probability that defines a cutoff frequency;

spectral amplitude estimation section, responsive to the output of the pitch detection section and the voicing estimation section for generating an amplitude estimation for each harmonic; and a background noise generation section responsive to the output of said pitch detection section and voicing estimation section for modifying the amplitude estimation for each harmonic from said spectral amplitude estimation section.

2. A speech codec, as claimed in claim 1, wherein said background noise generation section comprises:

voice activity detection section responsive to periodicity and an autocorrelation function;

a noise spectrum estimation section, responsive to the detection of voice activity and said pith detection section for estimating the noise spectrum of said speech signal;

a section responsive to said estimated noise spectrum and said pitch detection section and being operative to calculate harmonic by harmonic noise-signal ratio;

a noise reduction control section for generating a noise control signal in response to an auto correlation function; and a harmonic noise attenuation factor section, responsive to said pitch detection section, said noise reduction control section and said auto correlation function for modifying said speech spectrum signal to provide a noise reduced output.

3. The speech codec, as claimed in claim 2, wherein said noise spectrum estimation section is operative to generate a long term average noise spectrum as:

$$|N_m(\omega)| = \begin{cases} \alpha|N_{m-1}(\omega)| + (1-\alpha)|U(\omega)|; & \text{if } VAD = 0; \\ |N_{m-1}(\omega)|, & \text{otherwise.} \end{cases} \tag{2}$$

where $0 \leqq \omega \leqq \pi$, $|N_m(\omega)|$ is the long term noise spectrum magnitude, $\alpha$ is a constant that is can be set to 0.95, and VAD=0 means that speech is not active.

4. The speech codec, as claimed in claim 3, wherein $U(\omega)$ is one of the current signal spectrum and a harmonic spectral amplitude calculated as:

$$A_k = \sqrt{\frac{1}{\omega_0} \sum_{\omega=(k-0.5)\omega_0}^{(k+0.5)\omega_0} |S(\omega)|^2} \tag{3}$$

where $A_k$ is the $k^{th}$ harmonic spectral amplitude, and $\omega_0$ is the fundamental frequency of the current signal, $|S(\omega)|$, and interpolated to have a fixed dimension spectrum as:

$$\overline{U}(\omega) = A_k + [A_{k+1} - A_k(i)]\frac{(\omega - k\omega_0)}{\omega_0}; \quad k\omega_0 \le \omega \le (k+1)\omega_0 \tag{4}$$

where $1 \leqq k \leqq L$ and L is the total number of harmonics within a speech band.

5. The speech codec as claimed in claim 2 wherein said voice activity detection section controls noise reduction gain frame by frame.

6. The speech codec as claimed in claim 2 wherein an attenuation factor for each harmonic is computed on the basis of estimated noise to signal ratio (ENSR) for each harmonic lobe.

7. The speech codec as claimed in claim 6, wherein the ENSR for the kth harmonic is computed as:

$$\gamma_k = \frac{\sum_{\omega=B_L^k}^{B_U^k} [N_m(\omega)W_k(\omega)]^2}{\sum_{\omega=B_L^k}^{B_U^k} [S(\omega)W_k(\omega)]^2} \tag{7}$$

where $\gamma_k$ is the $k^{th}$ ENSR, $N_m(m\}(\omega)$ is the estimated noise spectrum $S(\omega)$ is the speech spectrum and $W_k(\omega)$ is the window function computed as:

$$W_k(\omega) = 0.52 - \left(0.48 \cos\left(\frac{2\pi[\omega - B_L^k]}{[B_U^k - B_L^k]}\right)\right); \; B_L^k \le \omega < B_U^k \tag{8}$$

where $B_L^k$ and $B_U^k$ are the lower and upper limits for the $k^{th}$ harmonic and computed as:

$$B_L^k = \left(k - \frac{1}{2}\right)\omega_0 \tag{9}$$

$$B_U^k = \left(k + \frac{1}{2}\right)\omega_0 \tag{10}$$

where $\omega_0$ is the fundamental frequency of the corresponding speech sequence.

8. The speech codec, as claimed in claim 6, wherein the noise attenuation factor for each harmonic is used to scale computed harmonic amplitudes.

9. The speech codec, as claimed in claim 2, further comprising a LPC filter that models the characteristics of the speech spectrum, said filter being represented by a plurality of line spectral frequency parameters.

10. A method of correcting for background noise in a speech codec comprising:

detect voice activity for each frame of speech signal, based on the periodicity $P_0$ and the auto-correlation function ACF of the speech signal;

update the noise spectrum every speech segment where speech is not active, and estimate a long term noise spectrum;

calculate a harmonic-by-harmonic noise-signal ratio and interpolate the harmonic spectral amplitudes;

calculate long term average ACF and on the basis of an input of the detected voice activity provide an input to control the noise reduction gain, $\beta_m$, from one frame to the next one;

compute an attenuation factor for each harmonic based on the Estimated Noise to Signal Ratio (ENSR) for each harmonic lobe;

calculate a noise attenuation factor for each harmonic; and apply the noise attenuation factor to scale the harmonic amplitudes that are computed during the encoding process.

11. The method of claim 10 wherein the updating step is performed on the basis of U(w) being the current signal spectrum.

12. The method of claims 11 wherein the harmonic specs amplitudes are interpolated to have a fixed dimension spectrum.

13. The method of claim 12 wherein the fixed dimension spectrum is defined as $$U(\omega) = A_k + [A_{k+1} - A_k(i)]\frac{(\omega - k\omega_0)}{\omega_0}; \quad k\omega_0 \le \omega \le (k+1)\omega_0. \tag{4}$$

14. The method of claim 10 wherein the updating step is performed on the basis of an estimation of the spectral amplitudes as:

$$A_k = \sqrt{\frac{1}{\omega_0} \sum_{\omega=(k-0.5)\omega_0}^{(k+0.5)\omega_0} |S(\omega)|^2}\ . \tag{3}$$

15. The method of claims 14 wherein the harmonic spectral amplitudes are interpolated to have a fixed dimension spectrum.

16. The method of claim 15 wherein the fixed dimension spectrum is defined as $$U(\omega) = A_k + [A_{k+1} - A_k(i)]\frac{(\omega - k\omega_0)}{\omega_0}; \quad k\omega_0 \le \omega \le (k+1)\omega_0. \tag{4}$$

* * * * *